US006203371B1

(12) United States Patent
Dunn et al.

(10) Patent No.: US 6,203,371 B1
(45) Date of Patent: Mar. 20, 2001

(54) METHOD AND APPARATUS FOR CAPPING AND GROUNDING AN ELECTRICAL CONNECTOR TO PREVENT LEAKAGE OF ELECTROMAGNETIC INTERFERENCE

(75) Inventors: William R. Dunn; Joseph W. Goode, III, both of Alpharetta; Daniel E. Molnar, Lawrenceville, all of GA (US)

(73) Assignees: Universal Avionics Systems Corporation-Instrument Division, Norcross, GA (US); L-3 Communications Corporation, New York, NY (US)

( * ) Notice: Subject to any disclaimer, the term of this patent is extended or adjusted under 35 U.S.C. 154(b) by 0 days.

(21) Appl. No.: 09/262,908

(22) Filed: Mar. 5, 1999

Related U.S. Application Data

(60) Provisional application No. 60/076,881, filed on Mar. 5, 1998.

(51) Int. Cl.[7] ..... H01R 13/648
(52) U.S. Cl. ..... 439/607; 439/939
(58) Field of Search ..... 439/607, 939, 439/108, 554, 184; 174/35 C

(56) References Cited

U.S. PATENT DOCUMENTS 4,906,201 * 3/1990 Young et al. ..... 439/108
4,938,714 * 7/1990 Kawai et al. ..... 439/607
5,169,341 12/1992 Nakata et al. ..... 439/607
5,356,300 10/1994 Costello et al. ..... 439/101
5,470,239 11/1995 Rancourt ..... 439/105
5,959,244 * 9/1999 Mayer ..... 174/35 GC
6,033,263 * 3/2000 Weidler et al. ..... 439/620

* cited by examiner

*Primary Examiner*—Neil Abrams
*Assistant Examiner*—Michael C. Zarroli
(74) *Attorney, Agent, or Firm*—Stanley & Gilcrest LLP

(57) ABSTRACT

The present invention is a method and apparatus for capping and grounding an electrical connector to prevent leakage of electromagnetic interference into or out of a chassis for a piece of electronic equipment. In a preferred embodiment of the present invention, a chassis panel has a conductive area that may serve as chassis ground. The electrical connector is secured to the chassis panel, and it is disposed over a penetration in the chassis panel. The electrical connector has a conductive shell that is electrically tied to chassis ground. An EMI plate caps the electrical connector, and it is also electrically tied to chassis ground. The EMI plate permits the transmission of desired signals into and out of the chassis via the electrical connector and associated conductors while substantially preventing leakage of electromagnetic interference through the electrical connector.

16 Claims, 7 Drawing Sheets

METHOD AND APPARATUS FOR CAPPING AND GROUNDING AN ELECTRICAL CONNECTOR TO PREVENT LEAKAGE OF ELECTROMAGNETIC INTERFERENCE

This application claims the benefit of U.S. Provisional Application No. 60/076,881, filed Mar. 5, 1998.

BACKGROUND AND SUMMARY OF THE INVENTION

The present invention relates generally to a method and apparatus for preventing leakage of electromagnetic interference, and more particularly, to a method and apparatus for capping and grounding an electrical connector to prevent leakage of electromagnetic interference. The present invention is of particular use in avionic instrumentation display units. Avionic instrumentation display units are essential on military, commercial, and private aircraft to provide the pilot and co-pilot, if any, with the information which is necessary to fly the aircraft. Typically, the primary avionic instrumentation display units are located on the instrumentation panel which is below the windshield and in front of the seats occupied by the pilot and co-pilot, if any. On the other hand, the secondary avionic instrumentation display units are often located on an overhead instrumentation panel that is above the windshield.

The majority of modem military, commercial, and private aircraft instrumentation panels utilize ARINC cutouts for the avionic instrumentation display units. In other words, there is a standard instrumentation panel cutout for each avionic instrumentation display unit. The ARINC cutouts are spaced closely together. The dimensions and close proximity of the ARINC cutouts limit the size of the face of each display unit. In addition, the dimensions and close proximity of the ARINC cutouts limit the chassis size of each display unit. A chassis commonly houses the circuitry and components of the display unit. Due to restricted chassis size, only a limited amount of space is available to mount and wire the circuitry and components of each display unit.

As a further result of the aforementioned size limitations, electromagnetic fields may interfere with the performance of avionic instrumentation display units. An electromagnetic field is a combination of electric and magnetic fields. Propagating electromagnetic fields are produced by charged particles that are subjected to acceleration. For example, the flow of electrons in a conductor carrying an alternating current produces an electromagnetic field that propagates outward from the conductor.

When an alternating current flows through a conductor, the resulting electromagnetic field exerts forces on nearby charged particles. In particular, the electromagnetic field causes electron movement at the same frequency in nearby conductors even though the nearby conductors are not electrically connected to the current-carrying conductor. This phenomenon is known as electromagnetic induction.

Electromagnetic interference is an electromagnetic field that interferes with other signals and degrades the performance of an electronic device. Three general methods of suppressing electromagnetic interference are grounding, shielding, and filtering. For instance, it is known to properly ground the signals in a system, and it is known to utilize electromagnetic shielding. It is also known to physically isolate the power from the other signals. This may be accomplished by physically separating the wiring and by physically separating the runs on the circuit boards. Furthermore, it is known to place a line filter in series with an alternating current power input in order to suppress electromagnetic interference to an acceptable level while permitting the 50 or 60 Hz current to pass with little or no attenuation. In this manner, a line filter essentially traps electromagnetic interference and prevents it from leaving.

Electromagnetic shielding prevents an electromagnetic field from entering or leaving a desired area. In other words, electromagnetic shielding prevents unwanted coupling between circuits. A common form of electromagnetic shielding generally includes a grounded chassis that is made of conductive material. As used herein, the term "conductive" shall be understood to mean electrically conductive. The grounded chassis serves as the reference point for an electronic circuit. The grounded chassis may be perforated. However, the apertures should be very small compared to the wavelength of the electromagnetic field in order to effectively block the electromagnetic field.

Penetrations in a chassis limit its shielding effectiveness. Nonetheless, a number of penetrations are typically made in a chassis for electronic equipment. For instance, a chassis for electronic equipment may have penetrations for convection cooling, forced air cooling, displays, fuses, switches, potentiometers, lamps, screws, windows, lights, filters, and electrical connectors. Consequently, the total shielding effectiveness is a function of all leakages associated with the various penetrations in the chassis.

A chassis for a piece of electronic equipment may have numerous penetrations for electrical connectors. Moreover, electromagnetic interference may enter or leave a chassis through any penetration for an electrical connector. An electrical connector may have a conductive shell that blocks some electromagnetic interference from entering or leaving the chassis through the penetration. However, a typical electrical connector also has a nonconductive insert that may allow electromagnetic interference to enter or leave the chassis through the penetration.

Consequently, a need exists for a method and apparatus that limits and preferably prevents leakage of electromagnetic interference into and out of a chassis through an electrical connector. Another need exists to cap and ground an electrical connector to prevent leakage of electromagnetic interference. Finally, there is still another need to cap and ground an electrical connector without consuming critical space within a chassis. As used herein, the term "cap" shall be understood to mean to position a piece of material relative to an electrical connector such that the piece of material may be adapted to block at least some electromagnetic interference from propagating through the electrical connector to a predetermined space.

The present invention satisfies one or more of these needs by providing a method and apparatus for capping and grounding an electrical connector. A preferred embodiment of the apparatus of the present invention includes an EMI plate that is adapted to prevent leakage of electromagnetic interference through a penetration in a chassis panel. The chassis panel is part of a chassis that houses a piece of electronic equipment. The chassis panel has a conductive area that may serve as chassis ground. The electrical connector is secured to the chassis panel, and it is disposed over the penetration. The electrical connector has a conductive shell that is electrically tied to chassis ground. The EMI plate caps the electrical connector, and it is also electrically tied to chassis ground. The EMI plate is preferably adapted to substantially prevent leakage of electromagnetic interference into and out of the chassis through the electrical connector.

A preferred embodiment of the EMI plate permits the transmission of desired signals into and out of a chassis via an electrical connector and associated conductors while substantially preventing electromagnetic leakage through the electrical connector. Accordingly, the EMI plate preferably has a plurality of conductor apertures. For example, the EMI plate may have a non-conductive aperture that is adapted to allow a predetermined conductor to pass through the EMI plate without being electrically tied to chassis ground. The EMI plate may also have a grounded aperture that is plated with conductive material that may be electrically tied to chassis ground. In addition, the EMI plate may have a conductive aperture that is plated with conductive material that is not electrically tied to chassis ground. For example, the EMI plate may form a portion of a printed wiring board, and the conductive aperture may be electrically tied to a run on the printed wiring board.

The electrical connector may be connected to the chassis by conventional means. The EMI plate may also be connected to the chassis by conventional means. It is preferred that the EMI plate is connected to the conductive shell of the electrical connector. In a preferred embodiment of the present invention, the EMI plate is secured to the conductive shell of the electrical connector by solder in bushings. In another preferred embodiment, the EMI plate is integrally connected to the shell of the electrical connector.

The EMI plate may be located inside or outside the chassis. The EMI plate is preferably located substantially adjacent to the rear of the electrical connector on the inside of the chassis. The EMI plate may simply cover the non-conductive insert of the electrical connector. However, it is preferred that the EMI plate substantially covers the penetration in the chassis as well as the non-conductive insert of the electrical connector.

The EMI plate may be comprised of any material that is adapted to block electromagnetic interference. The material may vary according to the particular application of the EMI plate. For instance, the EMI plate may be plated with a good conductor, such as copper or aluminum, in order to obtain high reflection loss of electromagnetic interference. On the other hand, the EMI plate may be plated with a relatively poor conductor, such as iron or a high-permeability alloy, in order to obtain high absorption loss of electromagnetic interference.

In a preferred embodiment of the present invention, approximately the entire EMI plate is plated with conductive material except in the immediate vicinity of any portion that is not desired to be conductive. Accordingly, it is preferred that the conductor apertures of the EMI plate are defined by non-conductive material except for those apertures which are desired to be conductive. In addition, it is preferred that the conductive material is sufficiently thick to provide adequate shielding against electromagnetic interference within a predetermined range of frequencies.

For applications that require a higher degree of shielding, at least one additional electromagnetic shield may be utilized which is adapted to further prevent leakage of electromagnetic interference into and out of the chassis through the electrical connector. In embodiments that utilize at least one additional electromagnetic shield, the additional electromagnetic shield(s) may be electrically tied to chassis ground. Similar to the EMI plate, the additional electromagnetic shield(s) may be comprised of or plated with any material that is adapted to block electromagnetic interference.

The additional electromagnetic shield(s) may form part of a printed wiring board. Like the EMI plate, the additional electromagnetic shield(s) may have one or more non-conductive apertures, conductive apertures, and/or grounded apertures. Moreover, each of the aforementioned apertures is preferably adapted to receive a respective conductor that passes through an aperture in the EMI plate.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a method and apparatus for capping and grounding an electrical connector to prevent leakage of electromagnetic interference. In particular, an EMI plate caps the electrical connector. The EMI plate is adapted to substantially prevent leakage of electromagnetic interference into and out of the chassis through the electrical connector. As a result, a preferred embodiment of the EMI plate permits the transmission of a signal via the electrical connector and associated conductors while substantially preventing electromagnetic leakage through the electrical connector.

Figure 1:
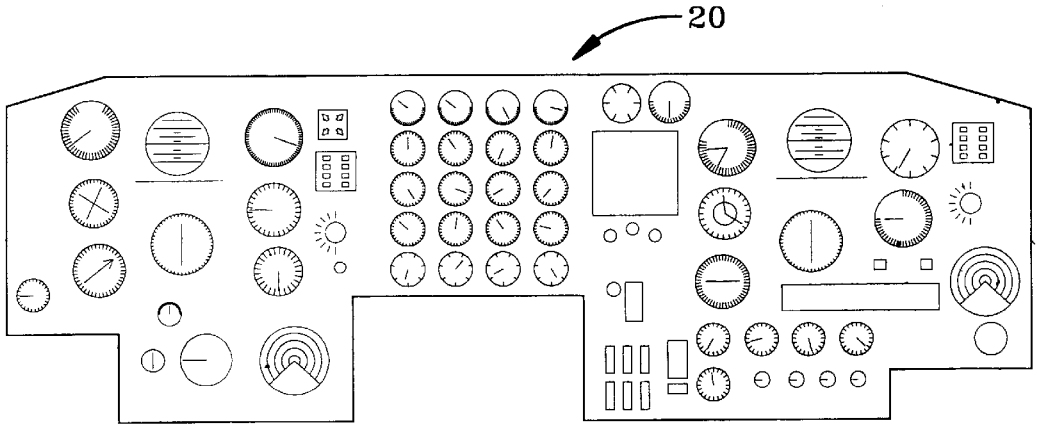
FIG. 1 is a partial perspective view of an embodiment of an aircraft cockpit.

FIG. 1 illustrates one embodiment of an aircraft cockpit. The cockpit includes an avionic instrumentation display system 20. The avionic instrumentation display system 20 may include primary flight instruments, engine and advisory instruments, cockpit displays, tactical situation displays, sensor data displays, and weapon system command and control displays. When powered, each of these instrumentation displays produces an electromagnetic field. Due to the close proximity of the instrumentation displays, the electromagnetic field of one instrumentation display could potentially degrade the performance of another instrumentation display.

Figure 2:
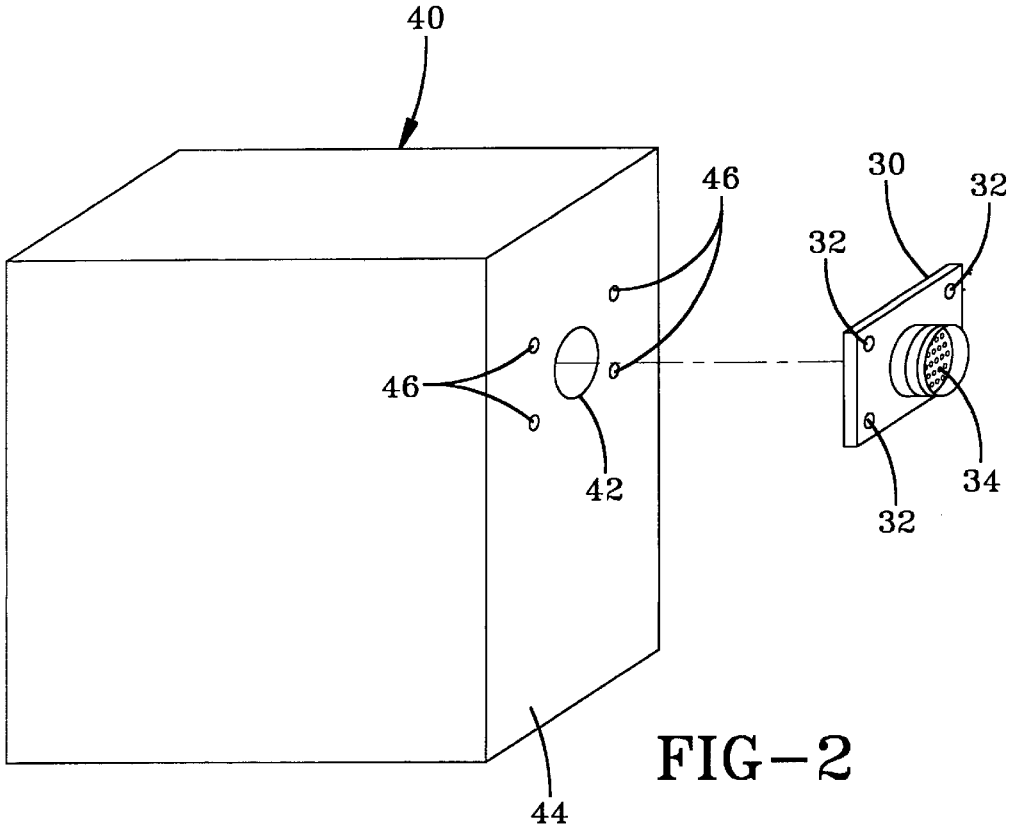
FIG. 2 is a perspective view of embodiments of a chassis and an electrical connector.

FIG. 2 shows an example of how an electrical connector 30 may be secured to a chassis 40 that houses a piece of electronic equipment. As shown, there is a penetration 42 in the chassis panel 44. The electrical connector 30 is abutted against the chassis panel 44 such that it is disposed over the penetration 42. Although not shown in FIG. 2, it should also be recognized that the electrical connector 30 may be disposed over the penetration 42 by inserting it through the penetration 42 from the other side of the panel 44. Holes 32 extend through the conductive shell of the connector 30. The holes 32 are aligned with respective holes 46 in the chassis panel 44 such that solder in bushings, nuts and bolts, or other conventional fastening means may be utilized to secure the electrical connector 30 to the chassis panel 44.

The electrical connector 30 commonly has a non-conductive insert 34 that enables conductors inside of the chassis 40 to be electrically tied to conductors outside of the chassis 40. As a result, signals may be transmitted into and out of the chassis 40 through the electrical connector 30. However, the non-conductive insert 34 typically does not effectively block electromagnetic interference. Consequently, electromagnetic interference may enter and leave the chassis 40 through the penetration 42 and the non-conductive insert 34 of the electrical connector 30.

Figure 3:
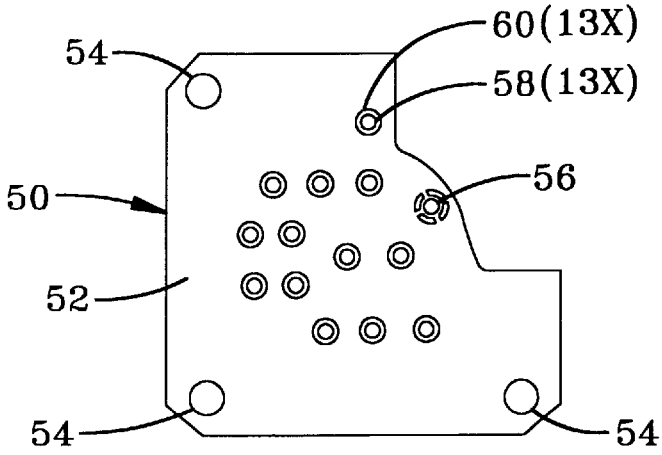
FIG. 3 is a side elevational view of a preferred embodiment of an EMI plate.

In order to prevent electromagnetic interference from leaking through an electrical connector that is disposed over a penetration in a chassis, the present invention caps the electrical connector with an EMI plate. FIG. 3 illustrates a preferred embodiment of an EMI plate 50. The EMI plate 50 is preferably a sheet. However, it should be understood that the EMI plate 50 may be thicker than a sheet, irregularly shaped, and/or a piece of material that has uneven surfaces.

The EMI plate 50 is comprised of a piece of material that is adapted to block electromagnetic interference. In this embodiment, the EMI plate 50 is comprised of a layer of non-conductive material that is plated with a conductive material 52. The conductive material 52 plates portions of the EMI plate 50 that are desired to be conductive. In order to most effectively block electromagnetic interference, the conductive material 52 preferably plates substantially all portions of the EMI plate 50 except those that are desired to be non-conductive.

The EMI plate 50 is preferably adapted to be electrically tied to the conductive shell of an electrical connector and to a conductive chassis panel. In this example, the EMI plate 50 includes a plurality of holes 54 that are plated with the conductive material 52. The holes 54 are preferably positioned such that they may be aligned with respective holes through the conductive shell of an electrical connector and/or with respective holes through a conductive chassis panel. A conductive fastening material or device may then be extended through the aligned holes to electrically tie the EMI plate 50 to the conductive shell of the electrical connector and to the conductive chassis panel. For example, solder in bushings may extend through the aligned holes to electrically tie together the EMI plate 50, the conductive shell of the electrical connector, and the conductive chassis panel. It should also be recognized that any other suitable means may be utilized to electrically tie the EMI plate 50 to the conductive shell of the electrical connector and/or to the conductive chassis panel.

A plurality of conductor apertures may extend through the EMI plate 50. The conductor apertures are preferably positioned in a pattern that substantially corresponds to the location of the pins and/or sockets of a predetermined electrical connector. A conductor aperture may be defined by conductive or non-conductive material.

Conductor aperture 56 is an example of a conductor aperture that is plated with conductive material 52. As a result, a conductor that extends into the conductor aperture 56 may be electrically tied to the EMI plate 50, chassis ground, and the conductive shell of the electrical connector. Solder or other suitable means may be used to secure and electrically tie the conductor to the material that defines conductor aperture 56. It should be recognized that the EMI plate 50 may include a plurality of conductor apertures 56.

The EMI plate 50 may also include one or more conductor apertures that are adapted to allow respective conductors to pass through the EMI plate 50 without being electrically tied to the EMI plate 50. For example, a conductor aperture 58 is defined by a ring of non-conductive material 60. As used herein, the term "ring" shall be understood to include any shape that may define an aperture. Consequently, a conductor may pass through a conductor aperture 58 without being electrically tied to the EMI plate 50.

In addition, the EMI plate 50 may include one or more apertures that are plated with conductive material that is not electrically tied to the conductive material 52. For example, the EMI plate 50 may form a portion of a printed wiring board, and the conductive aperture may be electrically tied to a run on the printed wiring board.

Figure 4:
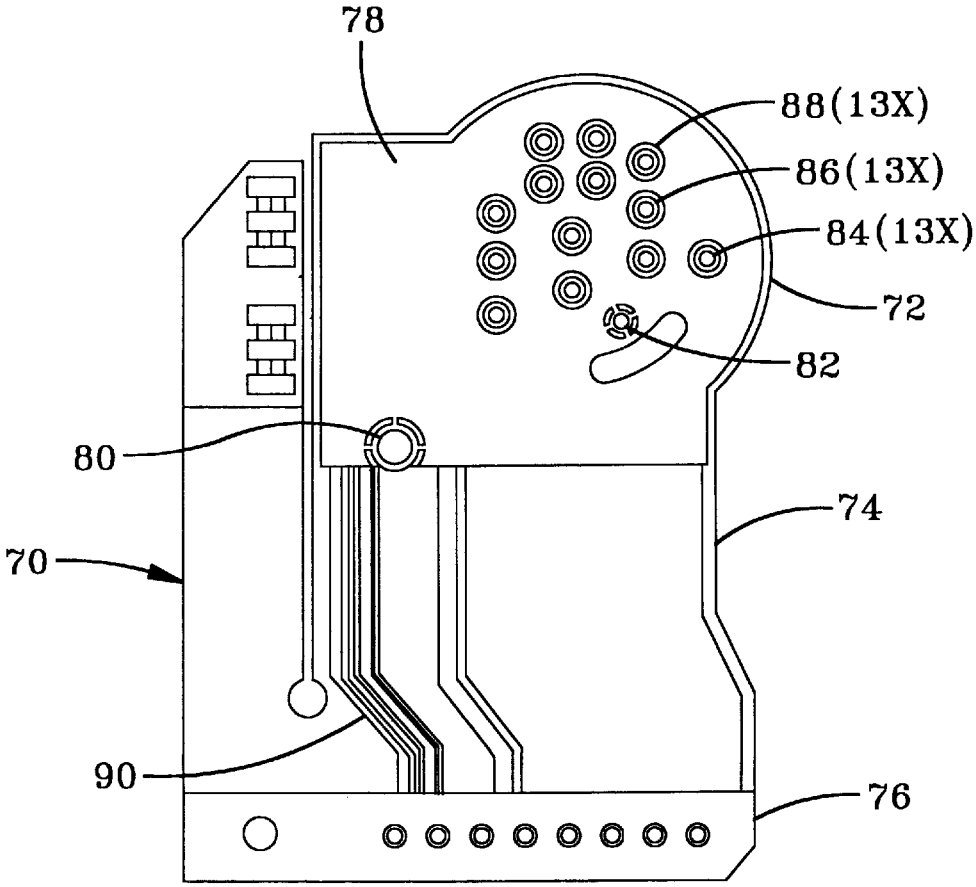
FIG. 4 is a side elevational view of a preferred embodiment of a rigid-flex-rigid printed wiring board.

FIG. 4 shows an embodiment of a rigid-flex-rigid printed wiring board 70. The printed wiring board 70 includes a rigid portion 72, a flexible portion 74, and another rigid portion 76. The rigid portion 72 has a portion which is plated with a material 78 that is adapted to block electromagnetic interference. It is preferred that the material 78 is a conductive material. It should also be recognized that the opposite side of the rigid portion 72 may include a portion that is plated with a material that is adapted to block electromagnetic interference. The flexible portion 74 preferably enables the printed wiring board 70 to be doubled over such that the plated portion(s) block(s) electromagnetic interference from the remainder of the board.

The rigid portion 72 defines a hole 80 that is plated with the material 78. The hole 80 is preferably positioned such that it may be aligned with a respective hole through the conductive shell of an electrical connector, with a respective hole through a conductive chassis panel, and/or with a respective hole through another EMI plate. For example, the hole 80 may be positioned such that it may be aligned with a respective hole 54 of the EMI plate 50 upon installation. A conductive fastening material or device such as a solder in bushing or other suitable means may then be extended through the aligned holes to electrically tie the material 78 to the conductive shell of the electrical connector, to the conductive chassis panel, and/or the other EMI plate. It should be recognized that the rigid portion 72 may include more than one hole 80 which enables the material 78 to be electrically tied to other components as described above.

A plurality of conductor apertures may extend through the rigid portion 72. The pattern of conductor apertures preferably substantially corresponds to the location of the pins and/or plugs of a predetermined electrical connector. The conductor apertures that extend through the rigid portion 72 may be the same as or similar to those described above in regard to the EMI plate 50. In FIG. 4, the rigid portion 72 includes a conductor aperture 82. The conductor aperture 82 is plated with the material 78. As a result, a conductor that extends into the conductor aperture 82 may be electrically tied to another EMI plate, a conductive chassis panel, and/or the conductive shell of an electrical connector. The rigid portion 72 also includes a plurality of conductor apertures 84. Each conductor aperture 84 is defined by a ring of conductive material 86. The conductive material 86 is physically isolated from the conductive material 78 by a ring of non-conductive material 88. Each ring of conductive material 86 may be electrically tied to a run on the printed wiring board 70. Run 90 is one example of a run on the printed wiring board 70. Solder or other suitable means may be used to secure and electrically tie a conductor to the material that defines a conductor aperture 82 or a conductor aperture 84.

The plated portion(s) of rigid portion 72 may serve as an EMI plate. However, it is preferred to utilize the plated portion(s) of rigid portion 72 in conjunction with a separate EMI plate such as the one shown in FIG. 3. In this manner, the plated portion(s) of rigid portion 72 may serve as additional electromagnetic shields.

FIGS. 5–10 show various views of the inside of a rear panel 100 of a chassis for an avionic instrumentation display unit. Various components are not shown in FIGS. 6–10 for clarity. This example utilizes an EMI plate 102 similar to the one shown in FIG. 3. This example also utilizes a rigid-flex-rigid printed wiring board 104 similar to the one shown in FIG. 4.

In this example, an electrical connector 106 is disposed over a penetration in the rear panel 100 of the chassis. The conductive shell 108 of the electrical connector 106 is electrically tied to the rear panel 100, i.e., chassis ground, by conventional means. The EMI plate 102 is electrically tied to the conductive shell 108 of the electrical connector 106 by solder in bushings 110. The solder in bushings 110 also electrically tie the EMI plate 102 to chassis ground. The EMI plate 102 caps the rear of the electrical connector 106, and it also substantially covers the penetration in the rear panel 100. As a result, the EMI plate 102 is adapted to prevent leakage of electromagnetic interference into and out of the chassis through the penetration and the electrical connector 106.

Figure 5:
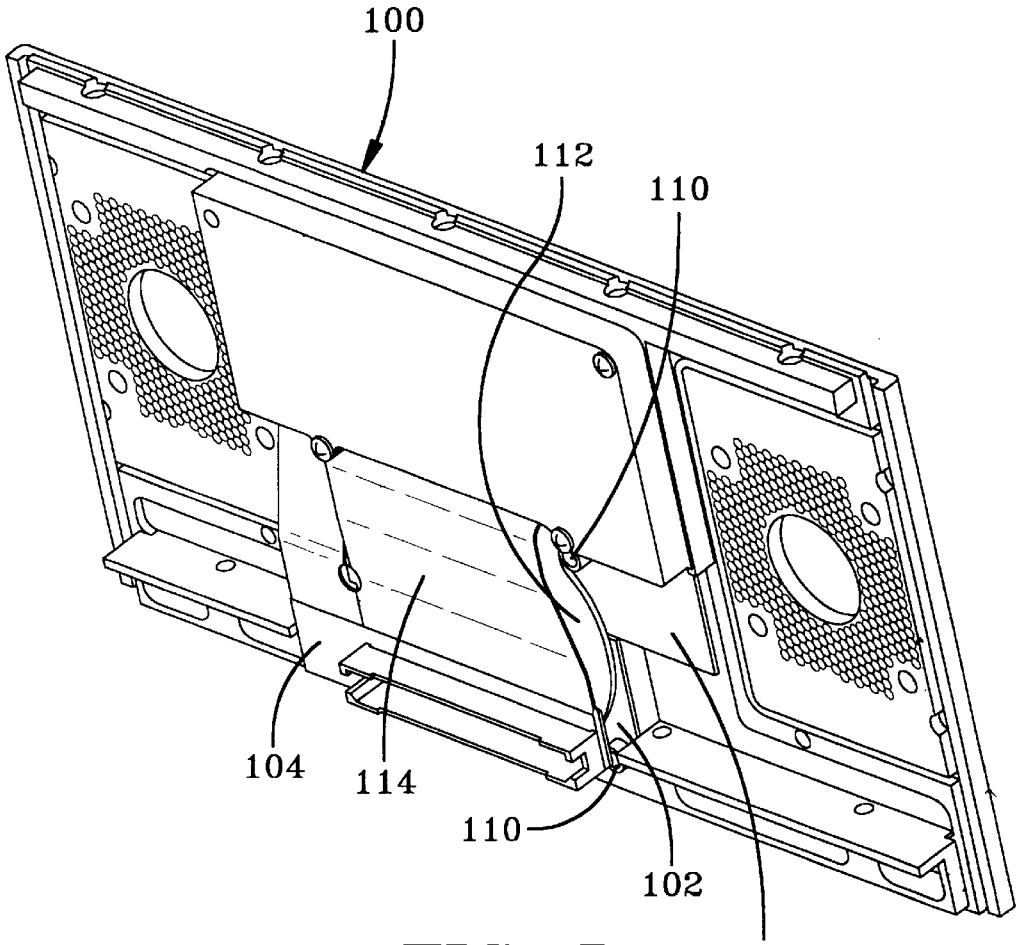
FIG. 5 is a perspective view of the inside of an embodiment of a rear panel of an avionic instrumentation display unit which utilizes preferred embodiments of the method and apparatus of the present invention.
Figure 6:
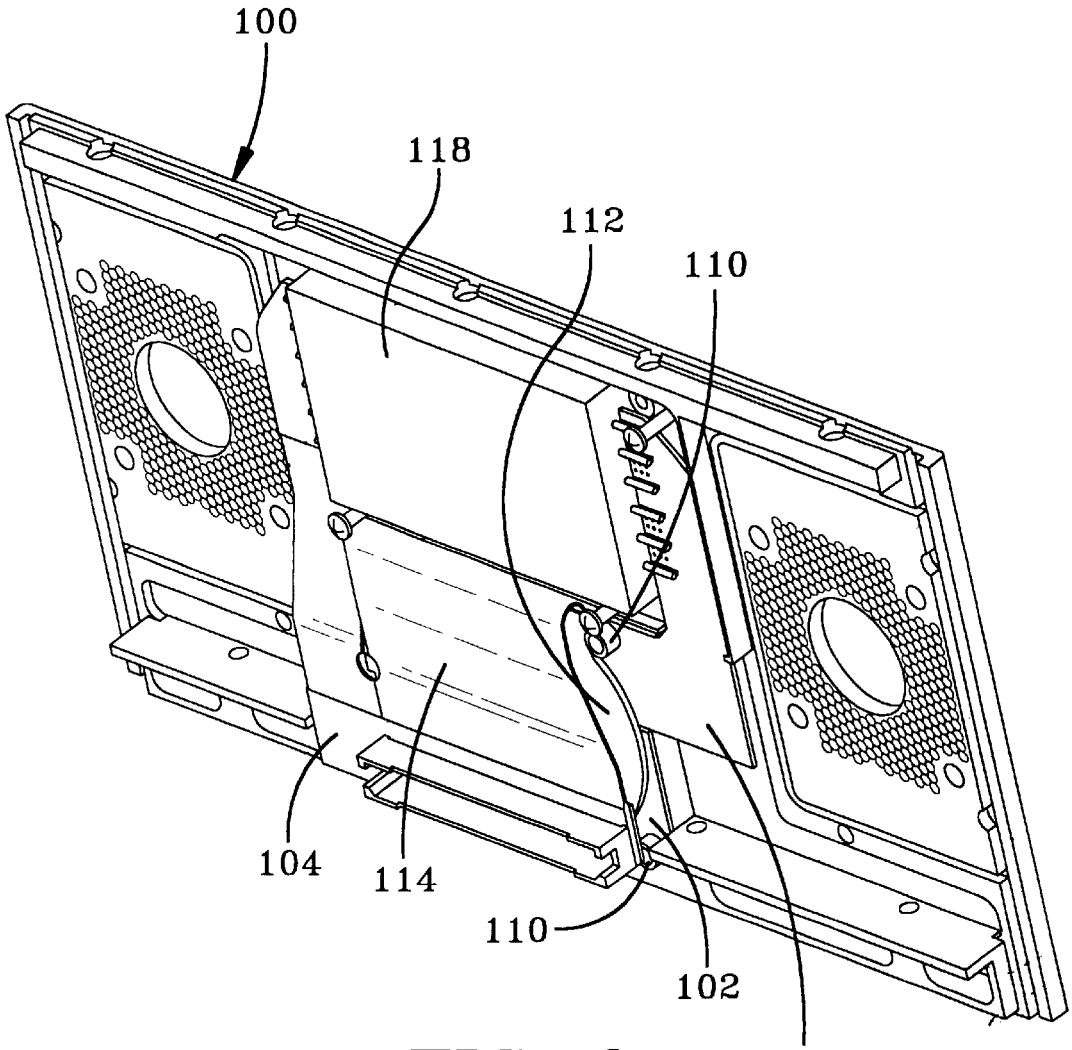
FIG. 6 is a perspective view of the inside of the rear panel shown in FIG. 5 with the EMI filter exposed.
Figure 7:
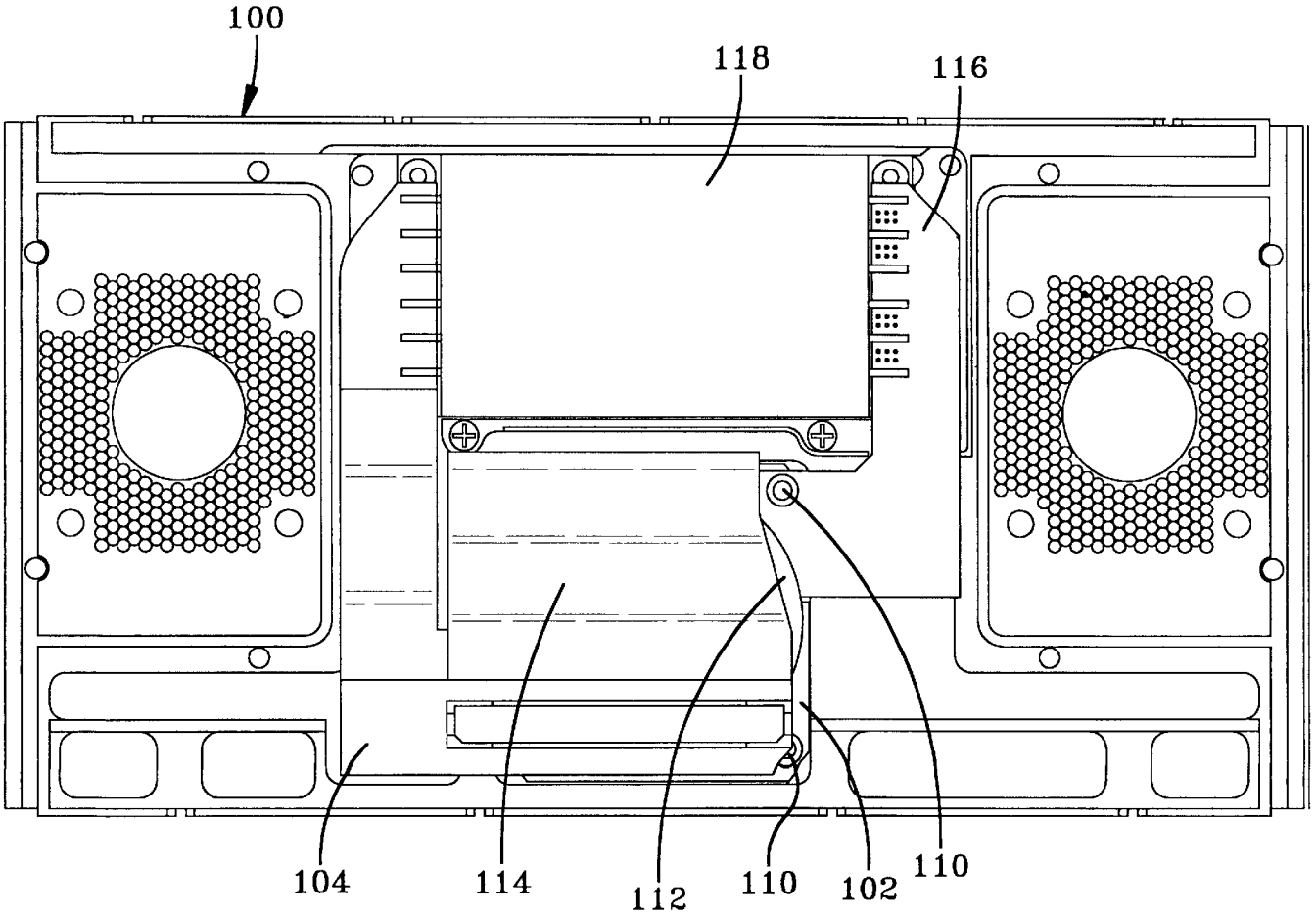
FIG. 7 is a side elevational view of the inside of the rear panel shown in FIG. 6.
Figure 8:
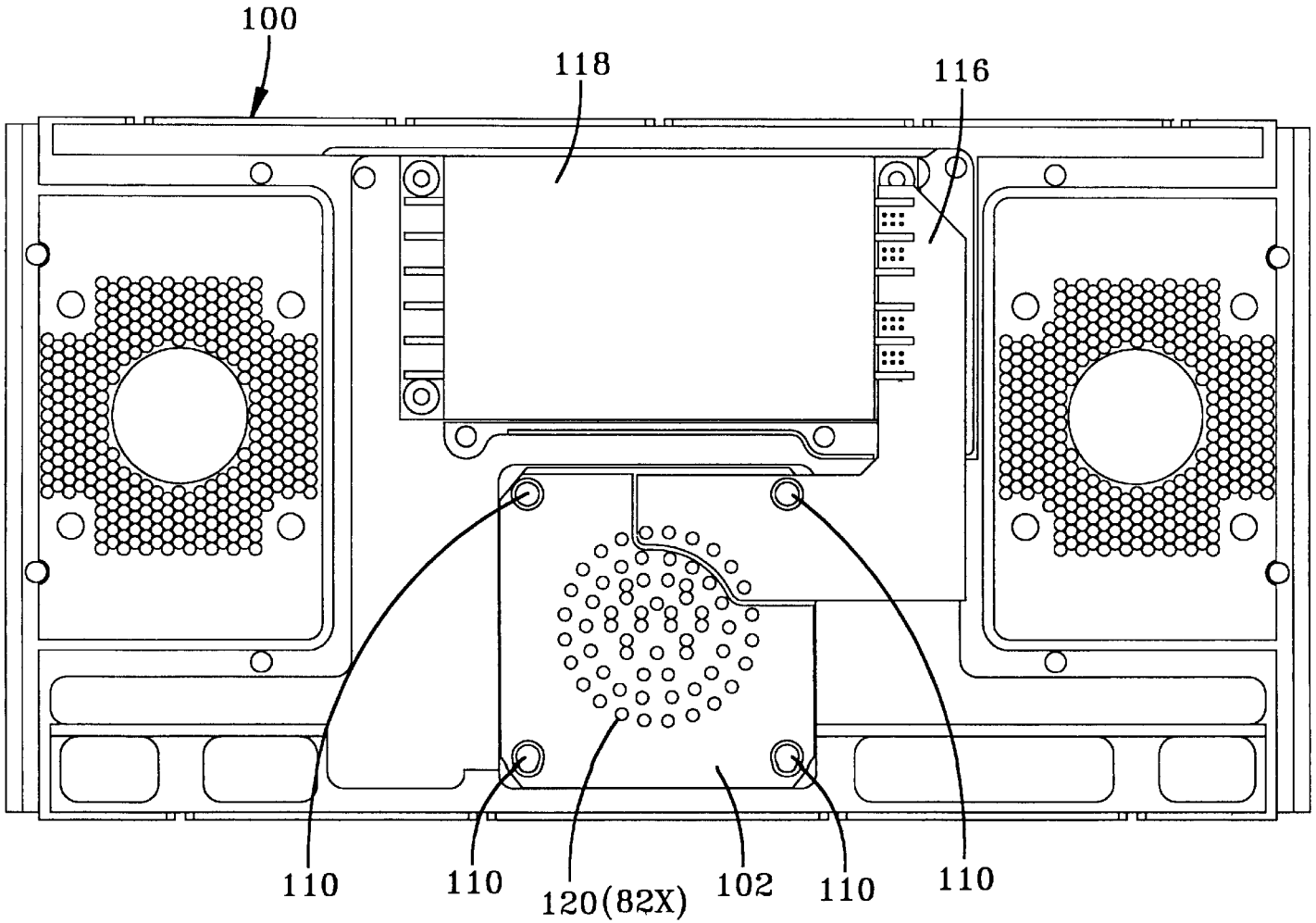
FIG. 8 is a side elevational view of the inside of the rear panel shown in FIG. 7 with the EMI plate exposed.

The rigid-flex-rigid printed wiring board 104 provides additional shielding against electromagnetic interference. The opposing plated portions of the board 104 are shown generally at 112. The opposing plated portions 112 are located approximately adjacent to the EMI plate 102. The opposing plated portions 112 are electrically tied to chassis ground by one of the solder in bushings 110, and they act as additional electromagnetic shields. As shown in FIGS. 5–7, the board 104 is doubled over such that the opposing plated portions 112 are sandwiched between the flexible portion 114 of the board 104 and the EMI plate 102. In this manner, the EMI plate 102 and the opposing plated portions 112 block electromagnetic interference from the runs in the flexible portion 114 of the board 104.

This example also physically isolates the power from the other signals. In particular, this embodiment includes a power printed wiring board 116 which is physically isolated from the board 104. An EMI filter 118 is also included to filter the power. One example of an EMI filter 118 is filter model number FMD28-461SL which is available from the Interpoint Corporation of Redmond, Wash.

A plurality of conductor apertures 120 extend through the EMI plate 102. In this example, conductor apertures that extend through the opposing plated portions 112 are substantially aligned with the conductor apertures 120 of the EMI plate 102. Consequently, signals may simply be transmitted between the board 104 and the electrical connector 106.

Figure 9:
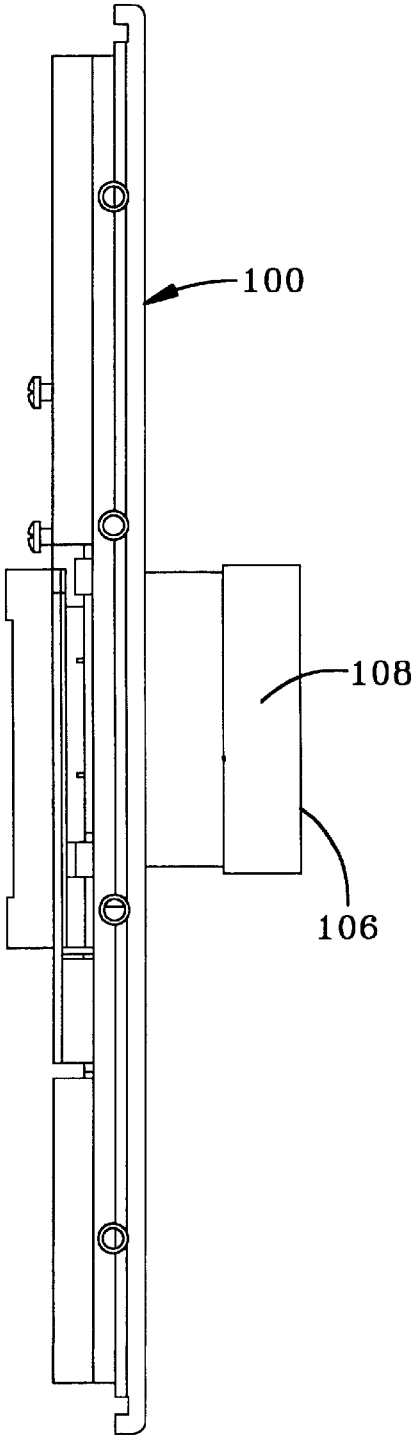
FIG. 9 is a top plan view of the rear panel shown in FIG. 5 with various components removed for clarity.
Figure 10:
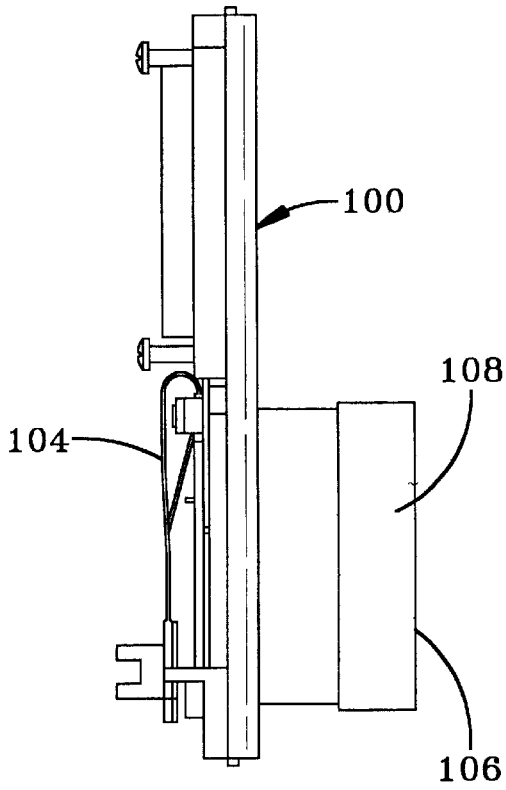
FIG. 10 is a side elevational view of the rear panel shown in FIG. 5 with various components removed for clarity.

A preferred embodiment of the present invention provides optimal protection against electromagnetic interference without consuming critical space. FIGS. 9 and 10 show the relatively thin profile that may be achieved with the present invention. As a result, the present invention may be utilized in a chassis that has a limited amount of available space.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the scope of the invention only as indicated by the scope of the claims.

What is claimed is:

1. An apparatus for limiting leakage of electromagnetic interference through an electrical connector, said electrical connector having a conductive shell and a non-conductive insert, said electrical connector disposed over a penetration that extends through a panel of a chassis, said panel adapted to serve as chassis ground, said conductive shell of said electrical connector connected to said panel such that said conductive shell is electrically tied to chassis ground, said apparatus comprising:

at least one piece comprised of a material that is adapted to block electromagnetic interference, said at least one piece substantially covering said penetration in said panel, said at least one piece connected and electrically tied to said conductive shell of said electrical connector, said at least one piece defining an aperture that is adapted to receive a conductor that extends from said electrical connector through said penetration in said panel;

wherein said at least one piece is adapted to limit leakage of electromagnetic interference into and out of said chassis through said penetration and said non-conductive insert of said electrical connector.

2. The apparatus of claim 1 wherein said at least one piece substantially covers said non-conductive insert.

3. The apparatus of claim 1 wherein said at least one piece is a sheet.

4. The apparatus of claim 1 wherein said material is conductive.

5. The apparatus of claim 4 wherein said at least one piece is comprised of a layer of non-conductive material that is plated with said conductive material.

6. The apparatus of claim 1 wherein said aperture is defined by a non-conductive material.

7. The apparatus of claim 1 wherein said aperture is defined by a conductive material.

8. The apparatus of claim 7 wherein said conductive material is electrically tied to chassis ground.

9. A method for limiting leakage of electromagnetic interference through an electrical connector, said electrical connector having a conductive shell and a non-conductive insert, said electrical connector disposed over a penetration that extends through a panel of a chassis, said panel adapted to serve as chassis ground, said conductive shell of said electrical connector connected to said panel such that said conductive shell is electrically tied to chassis ground, said method comprising:

providing at least one piece comprised of a material that is adapted to block electromagnetic interference, said at least one piece defining an aperture that is adapted to receive a conductor that extends from said electrical connector through said penetration in said panel;

substantially covering said penetration in said panel with said at least one piece; and connecting and electrically tying said at least one piece to said conductive shell of said electrical connector;

wherein said at least one piece is adapted to limit leakage of electromagnetic interference into and out of said chassis through said penetration and said non-conductive insert of said electrical connector.

10. The method of claim 9 wherein said at least one piece substantially covers said non-conductive insert.

11. The method of claim 9 wherein said at least one piece is a sheet.

12. The method of claim 9 wherein said material is conductive.

13. The method of claim 12 wherein said at least one piece is comprised of a layer of non-conductive material that is plated with said conductive material.

14. The method of claim 9 wherein said aperture is defined by a non-conductive material.

15. The method of claim 9 wherein said aperture is defined by a conductive material.

16. The method of claim 15 wherein said conductive material is electrically tied to chassis ground.

* * * * *